US012421005B2

(12) United States Patent
Murray et al.

(10) Patent No.: US 12,421,005 B2
(45) Date of Patent: Sep. 23, 2025

(54) UNDERGROUND SECURE STORAGE SYSTEM

(71) Applicants: Howard Murray, Whittier, CA (US); Hector Adriene Solano, Whittier, CA (US)

(72) Inventors: Howard Murray, Whittier, CA (US); Hector Adriene Solano, Whittier, CA (US)

( * ) Notice: Subject to any disclaimer, the term of this patent is extended or adjusted under 35 U.S.C. 154(b) by 40 days.

(21) Appl. No.: 18/435,487

(22) Filed: Feb. 7, 2024

(65) Prior Publication Data

US 2025/0250086 A1 Aug. 7, 2025

(51) Int. Cl.

| | |
|---|---|
| ***B65D 77/04*** | (2006.01) |
| ***B65D 8/00*** | (2006.01) |
| ***B65D 41/02*** | (2006.01) |
| ***B65D 51/24*** | (2006.01) |

(52) U.S. Cl.

CPC ..... *B65D 77/0486* (2013.01); *B65D 11/02* (2013.01); *B65D 41/02* (2013.01); *B65D 51/242* (2013.01)

(58) Field of Classification Search

CPC .... B65D 77/0486; B65D 11/02; B65D 41/02; B65D 51/242

See application file for complete search history.

(56) References Cited

U.S. PATENT DOCUMENTS

| | | | | |
|---|---|---|---|---|
| 2,610,443 | A * | 9/1952 | Carlson | E04H 13/003 220/301 |
| 4,665,668 | A * | 5/1987 | Serpico | G21F 5/12 220/259.3 |
| 5,603,401 | A * | 2/1997 | Brunner | B65D 81/266 206/204 |
| 6,059,136 | A * | 5/2000 | Lin | B65D 45/32 220/212.5 |
| 6,253,944 | B1 * | 7/2001 | Osten | A45C 11/22 220/4.24 |
| 2005/0200484 | A1 * | 9/2005 | Minarovic | G01V 15/00 340/572.8 |

(Continued)

OTHER PUBLICATIONS

Pintrest; Survival Caches; https://www.pinterest.com/kirkrobinson62/survival-caches/.

(Continued)

*Primary Examiner* — Shawn M Braden

(57) ABSTRACT

The disclosure concerns a secure storage system which is installed underground. The user may insert their valuables into the storage compartment of the storage container before installing the it below ground. By using this system the user is making it harder for nefarious persons to steal their valuables. The storage compartment is sealed off from the environment to protect its contents. This underground storage system protects valuables from unpredictable disasters, both natural and man-made. The secure storage system includes a storage container having at least one opening to insert valuables through. A cable is attached to the container so that a user can pull the storage container out of the ground more easily. A receiving sleeve is installed in the ground first. The storage container is inserted into a receiving sleeve making it easier to pull out the storage container when necessary.

18 Claims, 8 Drawing Sheets

(56) References Cited

U.S. PATENT DOCUMENTS

| | | | | |
|---|---|---|---|---|
| 2009/0114554 | A1* | 5/2009 | Earnest | A47G 19/2227 206/217 |
| 2015/0175352 | A1* | 6/2015 | Jacobson | B65F 1/16 220/375 |
| 2021/0206552 | A1* | 7/2021 | Botdorf | A45F 3/16 |

OTHER PUBLICATIONS

Amazon; HQ Issue Gun Burial Tube Underground Storage Container, Waterproof Rifle Case, 12×46.5; https://www.amazon.com/HQ-ISSUE-Burial-Tube-46-5/dp/B06XGZJNHJ.

* cited by examiner

UNDERGROUND SECURE STORAGE SYSTEM

CROSS-REFERENCE TO RELATED APPLICATIONS

This application claims benefit of priority with U.S. Provisional Application Ser. No. 63/577,226, filed Apr. 10, 2023; the entire contents of which are hereby incorporated by reference.

BACKGROUND

Field of the Invention

This invention relates to secure storage systems; more particularly, to security safe systems which are installed underground.

Description of the Related Art

It is common for families and individuals to possess valuables which they would like to keep secure. These valuables could be money, jewelry, precious metals, important documents, digital memory devices, or other important objects. One common device used to securely store valuables is a conventional security safes. However, conventional security safes have a variety of drawbacks which make them unsuitable in many scenarios.

Conventional security safes are typically made from a tamper/attack resistant materials such as steel. This makes them heavy and typically more difficult to hide. There is a need for a lighter-weight secure storage system which may be easier for a user to transport and install in a hidden location.

Despite the ability of a conventional security safe to resist unauthorized tamper and/or attack, with enough time virtually any conventional security safe may be beaten by either destructive or non-destructive means. There is a need for a secure storage system which is easier to conceal or hide from would-be attackers, thereby denying them the opportunity to beat the safe by destructive or non-destructive means.

One method of hiding a safe may be to bury it in the ground. However, because safes are commonly made from metal materials a buried metal safe may be located using a metal detector. There is a need for an underground secure storage system which is difficult to locate using a metal detector.

In addition, the locking mechanisms within conventional security safes are usually intricate systems, using complicated, close-tolerance components. For that reason, they can be expensive to manufacture and consequentially expensive for a user to purchase conventional security safes. There is a need for a secure storage system which is less expensive than conventional security safes.

The underground secure storage system described herein aims to address these needs and others.

SUMMARY

The disclosure concerns a secure storage system which can be installed underground. The user may insert their valuables into the storage compartment of the storage container before installing the storage container below ground. By keeping their valuables in the underground storage container they are making it harder for nefarious persons to steal their valuables. The storage compartment is sealed off from the environment to protect its contents. By storing their valuables in the underground secure storage system, users are also protecting their valuables from unpredictable disasters, both natural and man-made.

In some situations, it may be necessary for the user to unbury their valuables quickly. There are a few important features of the secure storage system which facilitate relatively quick and simple removal of the storage container.

The storage container has a cable with a handle attached to it such that the user may pull up on the handle to pull the container out of the ground. Some versions of the storage container are specially shaped to reduce the frictional force of the dirt against the ground.

When an object is buried in the ground the dirt around it will slowly compact around the object. This compacted dirt can produce a significant frictional force against the object when it is being removed. To combat this friction an oversized receiving tube can be installed in the ground first. Then the storage container can be installed in the receiving tube. Then a shield may be installed on top of the receiving tube. The receiving tube pushes outward on the dirt and the shield prevents dirt from entering through the tube opening. This system helps prevent the dirt from backfilling around the storage container thereby making it easier to extract the storage container when necessary.

BRIEF DESCRIPTION OF THE DRAWINGS

Other features, combinations, and embodiments will be appreciated by one having the ordinary level of skill in the art of underground storage systems and accessories upon a thorough review of the following details and descriptions, particularly when reviewed in conjunction with the drawings, wherein.

DETAILED DESCRIPTION

Figure 1:
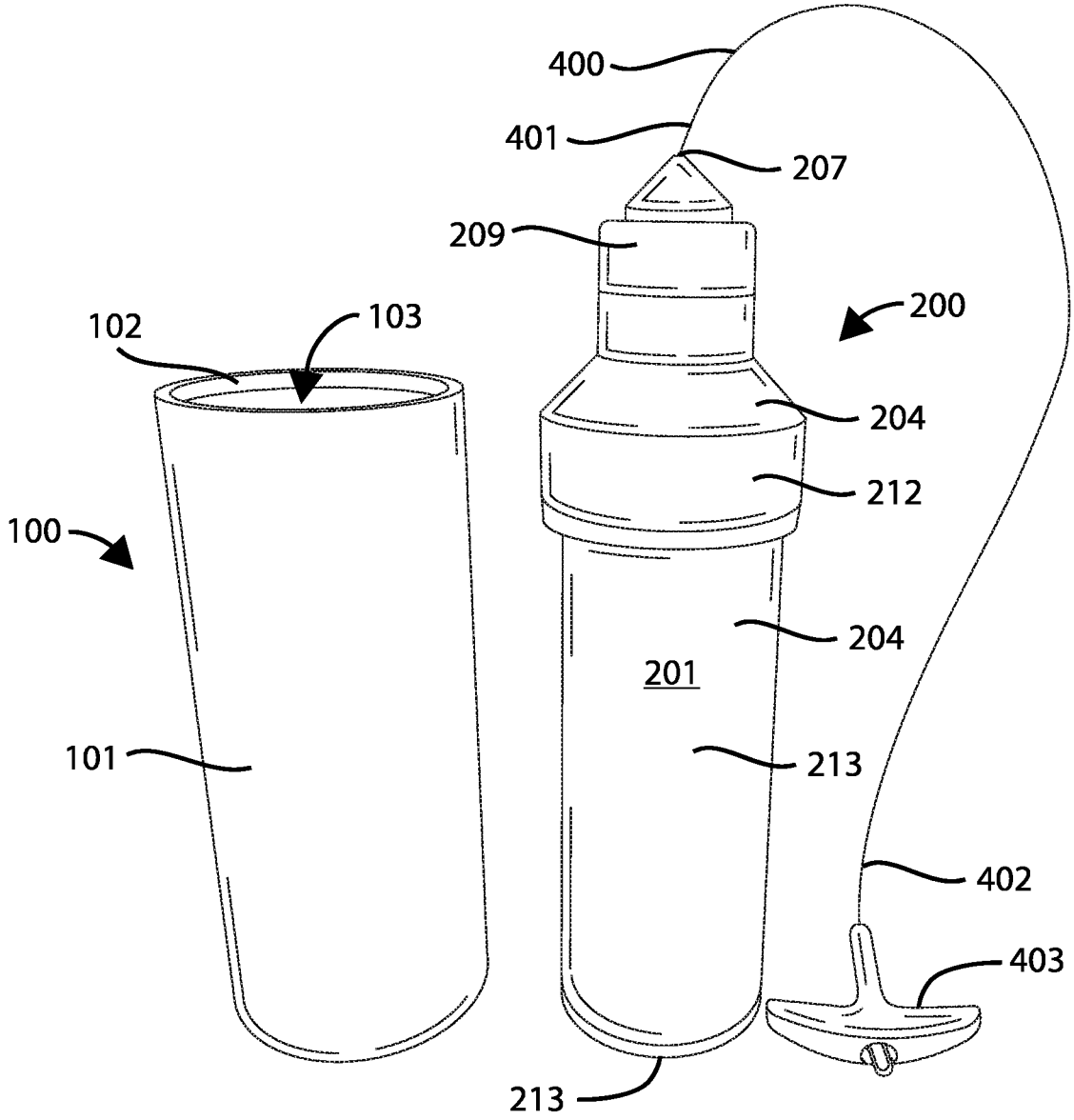
FIG. 1 shows a side perspective view of a underground secure storage system in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

For purposes herein, the term "ATTACHED" means permanently joined.

The term "COUPLED" means reversibly joined.

The term "CONTAINER PANEL" means a part or piece of the storage container which makes up the storage compartment.

The term "TUBE PANEL" means a part or piece of the receiving tube which makes up the tube compartment.

Unless explicitly defined herein, terms are to be construed in accordance with the plain and ordinary meaning as would be appreciated by one having skill in the art.

GENERAL DESCRIPTION OF EMBODIMENTS

The secure storage system comprising a receiving tube, a storage container, a plug, and a cable is described below.

In some embodiments, the receiving tube forms a tube compartment into which the storage container may be inserted. In some embodiments, the receiving tube may be installed in a hole in the ground. The receiving tube is intended to withstand the forces of the surrounding dirt pushing inward on the receiving tube. If a receiving tube is not used and the storage container is buried directly in the ground, the frictional forces of the dirt against the storage container will make it more difficult for the user to extract. The tube compartment may have one or more tube openings. The tube compartment does not need to be completely sealed off from the environment.

In some embodiments, the receiving tube may be formed from a plurality of tube panels. In the preferred embodiment, the receiving tube is formed from one tube panel which is generally cylindrically shaped.

The receiving tube may be installed in the ground with the longitudinal axis generally oriented vertically. The receiving tube may have at least one tube opening. When the tube is installed in the ground the tube opening may be oriented upward such that the user may insert the storage container into the tube.

The storage container forms an enclosure, called the storage compartment, into which a user may insert their valuables. The storage container may be formed from a plurality of container panels. A container panel is a part or piece which may be coupled or attached to other container panels to form the storage compartment. Some container panels are generally formed by a single plane which may be a curved plane or a flat plane. Other container panels may have multiple planes which are attached together. These planes may be flat, curved, conical, convex, concave, cylindrical or some combination thereof.

In some embodiments, the storage compartment may be made of two container panels. In some embodiments, the two-panel storage container may have a top cover and a central segment. The top cover may be coupled or attached to the upper end of the central segment.

In some embodiments, the storage container may be made of three container panels. In some embodiments, the three-panel storage container may have a top cover, a central segment, and a bottom cover.

In some embodiments, the storage container may be made of four container panels. In some embodiments, the four-panel storage container may have a top cover lid, top cover, a central segment, and a bottom cover. The lower end of the top cover lid may be attached or coupled to the upper end of the top cover. The lower end of the top cover may be attached or coupled to the upper end of the central segment. The lower end of the central segment may be attached or coupled to the upper end of the bottom cover.

In some embodiments, the storage container may be made of any number of container panels.

In some embodiments, the top cover lid may form cup shape having a generally cylindrical lid sidewall and a circular lid face covering the upper end of the top cover lid. In some embodiments, the top cover lid may, in part or in whole, form a generally conical or generally convex shape. The lid conical section of the lid may be oriented such that the narrower section of the conical shape is above the wider section of the conical shape. The conical shape may reduce the force required to pull the storage container out of the dirt.

In some embodiments, the top cover lid may be configured with a cable attachment point.

In some embodiments, the top cover may be a flat plane. In some embodiments, the top cover may, in part or in whole, form a generally conical shape. The top cover may be formed from three planes: a cylindrically shaped lower section, a conically shaped middle section, and a cylindrically shaped upper section. The top cover conical section of the top cover may be oriented such that the narrower section of the conical shape is above the wider section of the conical shape. The conical shape may reduce the force required to pull the storage container out of the dirt.

In some embodiments, the central segment may form a generally cylindrical shape.

In some embodiments, the bottom cover may be a flat plane. In some embodiments, the bottom cover may form cup shape having a cylindrical bottom cover sidewall and a circular bottom cover face which covers the lower end of the bottom cover. In some embodiments, the bottom cover may be configured with a container opening adapted to receive a plug. In some embodiments, the plug may have a plug spinner which is a feature which makes it easier to remove the plug, for example and without limitation a hex protrusion, a square protrusion, an Philips screw driver-shaped recess. The container opening may be disposed on the lower end of the bottom cover, which in some embodiments may be the lower end of the storage container.

In some embodiments, the container opening may have container threads disposed on the interior side of the container opening, and the plug may have plug threads disposed on the exterior side of the plug. The plug threads may be adapted to thread into the container threads.

In some embodiments, the container opening may have container threads disposed on the exterior side of the container opening, and the plug may have plug threads disposed on the interior side of the plug. The container threads may be adapted to thread into the plug threads.

When the plug is installed on the container opening the interior of the storage container is substantially sealed from the outside environment. When the storage container is substantially sealed from the outside environment the ingress of dirt, moisture, air, vegetation, or biological matter into the storage container is largely inhibited. In some embodiments, an elastic sealing component, for example and without limitation: an O-ring or a gasket, may be used to improve the storage container seal. In some embodiments, the elastic sealing component may be placed between the sealing surface of the plug and the sealing surface of the container opening such that when the plug is installed the elastic sealing component is compressed, further inhibiting the ingress of dirt, moisture, and air.

When the user goes to remove the storage container from the ground they may pull upwards on the cable attached to the storage container. In some embodiments, the storage container is configured with a cable attachment point, which is where the cable attaches or couples to the storage container. The cable attachment point may be located towards the upper end of the storage container. In some embodiments, the cable attachment point may be disposed on the top cover lid. In some embodiments, the cable attachment point may be disposed on the top cover.

Generally, the cable is a flexible, elongated member substantially capable of enduing tensile forces. The cable has at least two ends, a distal end and a proximal end. In some embodiments, the cable may comprise multiple cables attached to each other. In some embodiments the cable may be a loop. In such embodiments, the distal end of the loop is considered the distal end of the cable, and the proximal end of the loop is considered the proximal end.

The proximal end may be attached or coupled to the storage container. In some embodiments, the proximal end of the cable passes through a cable penetration in the storage container, and one or more fasteners may be attached to the proximal end. In some embodiments, a fastener may be wider than the cable penetration such that when a tensile force is applied to the distal end of the cable the fastener presses against the inside surface of the storage container, thereby retaining the cable to the storage container. There are a variety of methods for attaching or coupling the cable to the storage container which will be evident to one skilled in the art.

In some embodiments, a handle may be attached or coupled to the distal end. In some embodiments, the distal end of the cable passes through a handle penetration in the storage container, and one or more fasteners may be attached or coupled to the proximal end. In some embodiments, one or more of the fasteners may be wider than the handle penetration such that when a tensile force is applied to the handle, a fastener presses against the handle, thereby retaining the cable to the handle. There are a variety of methods for attaching or coupling the cable to the handle which will be evident to one skilled in the art.

If the cable attachment point takes the form of a cable penetration through the outside surface the invention may maintain its substantial seal from the outside environment in a variety of ways. In some embodiments, a wall may be attached or coupled to the inside surface of the storage container. In some embodiments, a wall may be attached or coupled to the lid connector of the storage container. The wall may separate the cable attachment point from the remainder of the storage compartment. There are a variety of methods for sealing off the cable penetration from the storage compartment which will be evident to one skilled in the art.

In some embodiments, after the receiving tube is installed and the storage container is installed in the receiving tube, a shield may be placed over the storage container. When placed over the receiving tube, the shield may help limit the ingress of dirt, water, or vegetation into the annular space between the storage container and the receiving tube. The shield may or may not be attached to the storage container.

The width of the shield in the horizontal direction may exceed the width of the upper end of the receiving tube in the horizontal direction. In some embodiments, the shield upper side may be generally convex. In some embodiments, the shield lower side may be generally concave. A shield having a concave lower side may be placed on top of the receiving tube such that the lower horizontal edges of the shield are at a lower elevation than the upper horizontal edge of the receiving tube. The shield is not required to make a tight fit with the receiving tube. The shield may simply rest on the receiving tube.

In some embodiments, the shield may have a feature to accommodate the cable. Because the cable may be pulled vertically, and the shield may be located above the storage container, the cable accommodating feature may reduce the interference between the cable and the shield. In some embodiments, the shield may have a cable slot cut through the shield from the horizontal perimeter of the shield into the horizontal interior of the shield. In some embodiments, the shield may have a cable aperture, which is a penetration between the shield upper side and the shield lower side. When the secure storage system is installed, the cable may be disposed through the cable slot or cable aperture such that the user may pull on the distal end of the cable or cable handle without first needing to removing the shield.

In some embodiments, the storage container may be generally made from acrylonitrile butadiene styrene (ABS). The panels of the storage container may be held together by applying an adhesive which is compatible with ABS to the interfacing surfaces of the storage container. Otherwise, the storage can be fabricated in accordance with the level and knowledge of one having skill in the art.

In some embodiments, the cable may be generally made from stainless steel. Otherwise, the cable can be fabricated in accordance with the level and knowledge of one having skill in the art.

While various details, features, components, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

First Illustrated Embodiment

Figure 2:
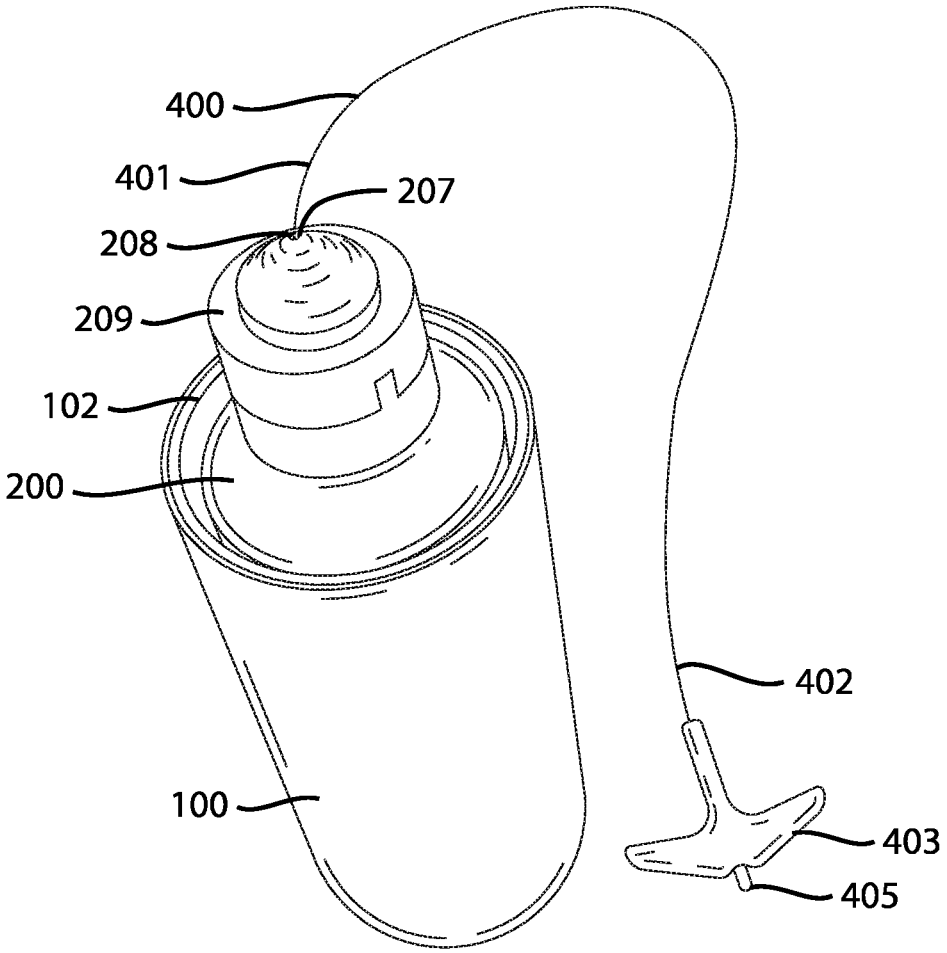
FIG. 2 shows a top perspective view of the underground secure storage system in accordance with a first illustrated embodiment.
Figure 3:
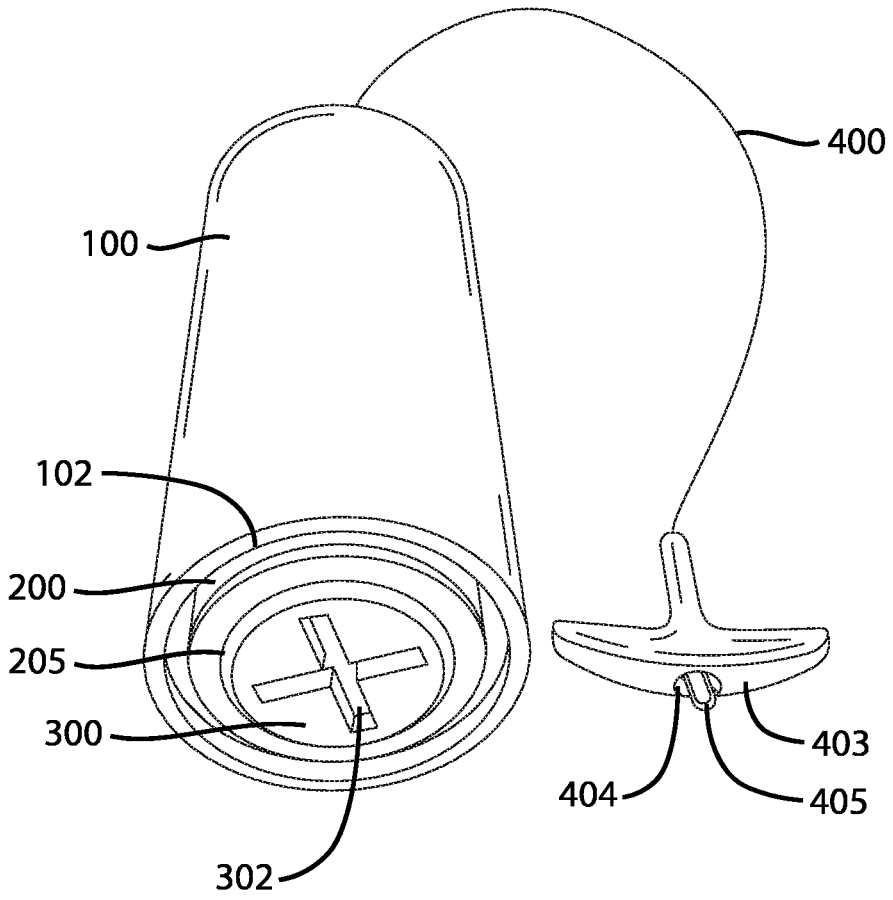
FIG. 3 shows a bottom perspective view of the underground secure storage system in accordance with a first illustrated embodiment.

A first illustrated embodiment of the underground secure storage system is shown in FIG. 1-FIG. 3. In FIG. 1 the receiving tube (100) and storage container (200) are shown. The receiving tube in this embodiment is formed by one tube panel (101). The receiving tube has a tube opening (102) leading into a tube compartment (103). The storage container has an outside surface (201) and an inside surface (202). The inside surface of the storage container forms a storage compartment (203). The parts of the storage container which form the storage compartment are collectively referred to as container panels (204).

FIG. 2 shows a top view of the the underground secure storage system storage container (200) inserted into the receiving tube (100). The storage container has a proximal end (401) of a cable (400) attached through a cable penetration (208) serving as the cable attachment point (207). This cable attachment point is on the top cover lid (209). A distal end (402) of the cable is attached to a handle (403). In this embodiment the cable passes through a handle penetration (404) and a fastener (405) is attached preventing the cable from pulling back through the handle penetration. A similar attachment method is used for the proximal end (401) cable attachment point (207) on the storage container for this embodiment as well.

FIG. 3 shows a bottom view of the storage container (200) inserted into the receiving tube (100). This figure shows the container opening (205) which is sealed with a plug (300)

having a plug spinner (302). The container plug may or may not be considered a container panel.

Second Illustrated Embodiment

Figure 4:
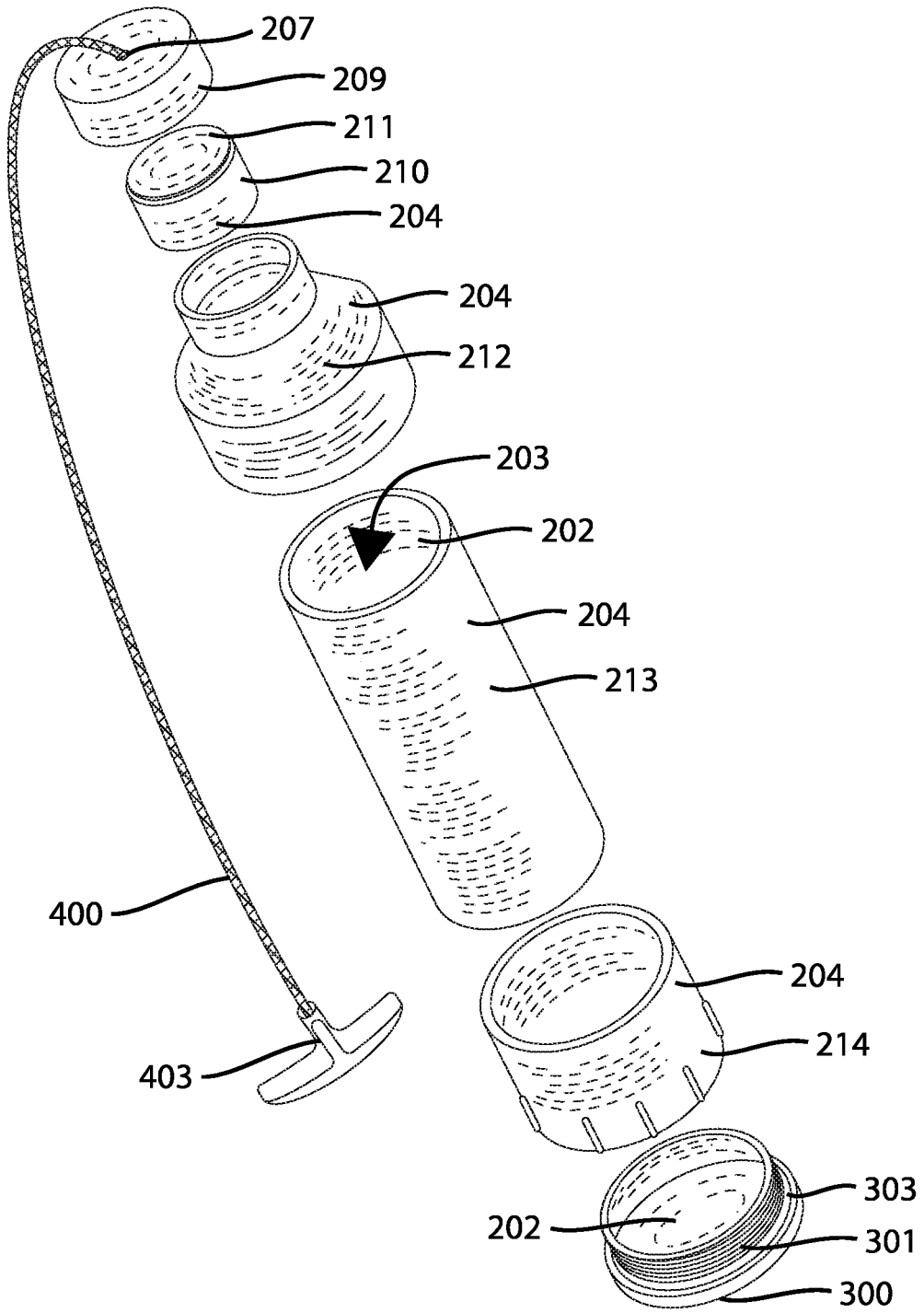
FIG. 4 shows an exploded view of a storage container in accordance with a second illustrated embodiment.
Figure 5:
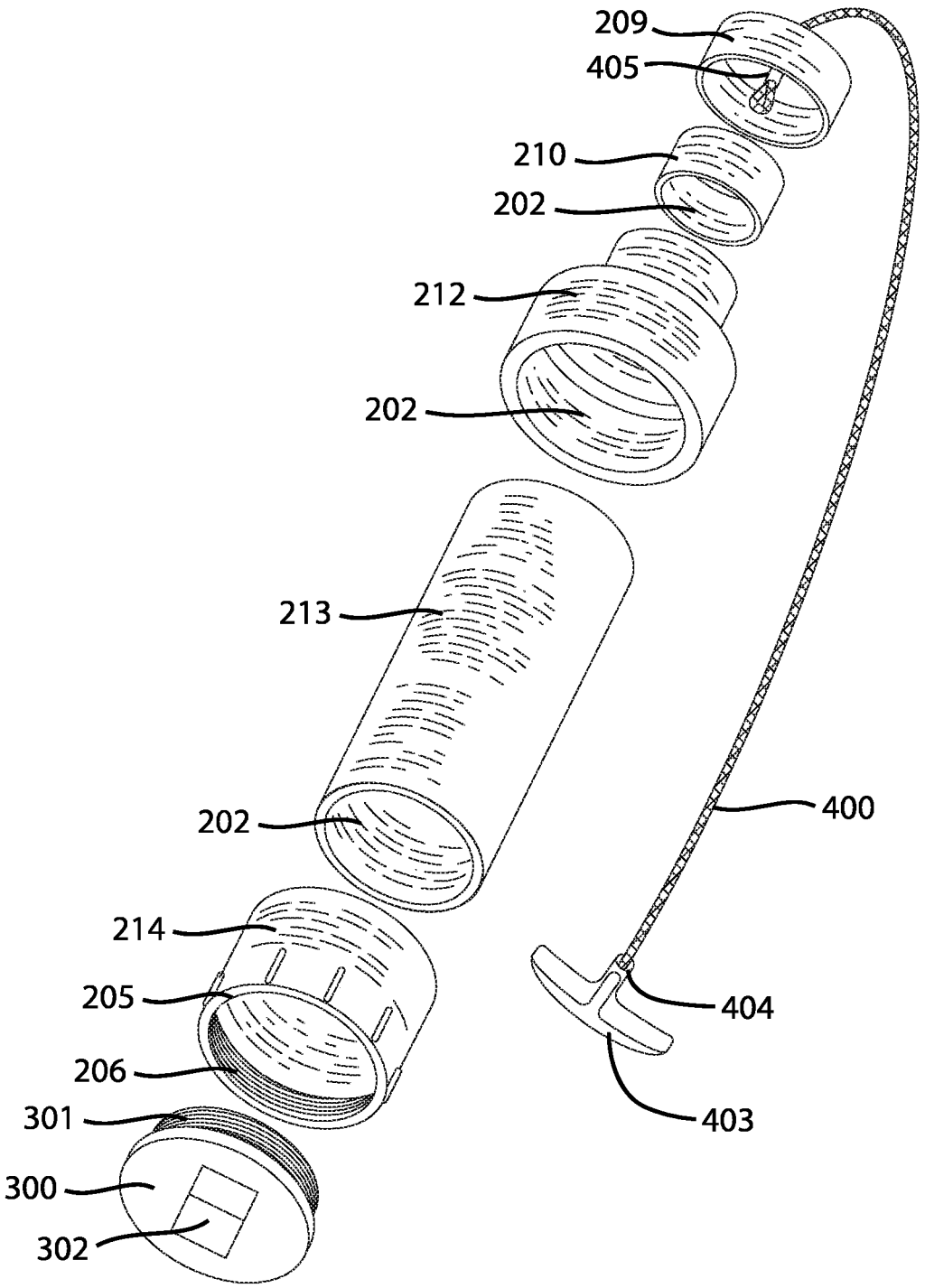
FIG. 5 shows an exploded view of the storage container in accordance with a second illustrated embodiment.

A second illustrated embodiment of the underground secure storage system is shown in FIG. 4-FIG. 8. An exploded view of the storage container is shown in FIG. 4-FIG. 5. In FIG. 4 the top cover lid (209), lid connector (210) having a wall (211), and top cover (212) are shown. In this embodiment, when the storage container is fully assembled, the lid connector is inserted into the top cover lid and the top cover. FIG. 4-FIG. 5 both show the central segment (213) between the top cover and bottom cover (214). FIG. 4 shows plug threads (301) on the plug which are threaded into the container threads (206) shown in FIG. 5. FIG. 4 shows an O-ring (303) on the bottom cover to form a substantial seal around the container opening (205)

Figure 6:
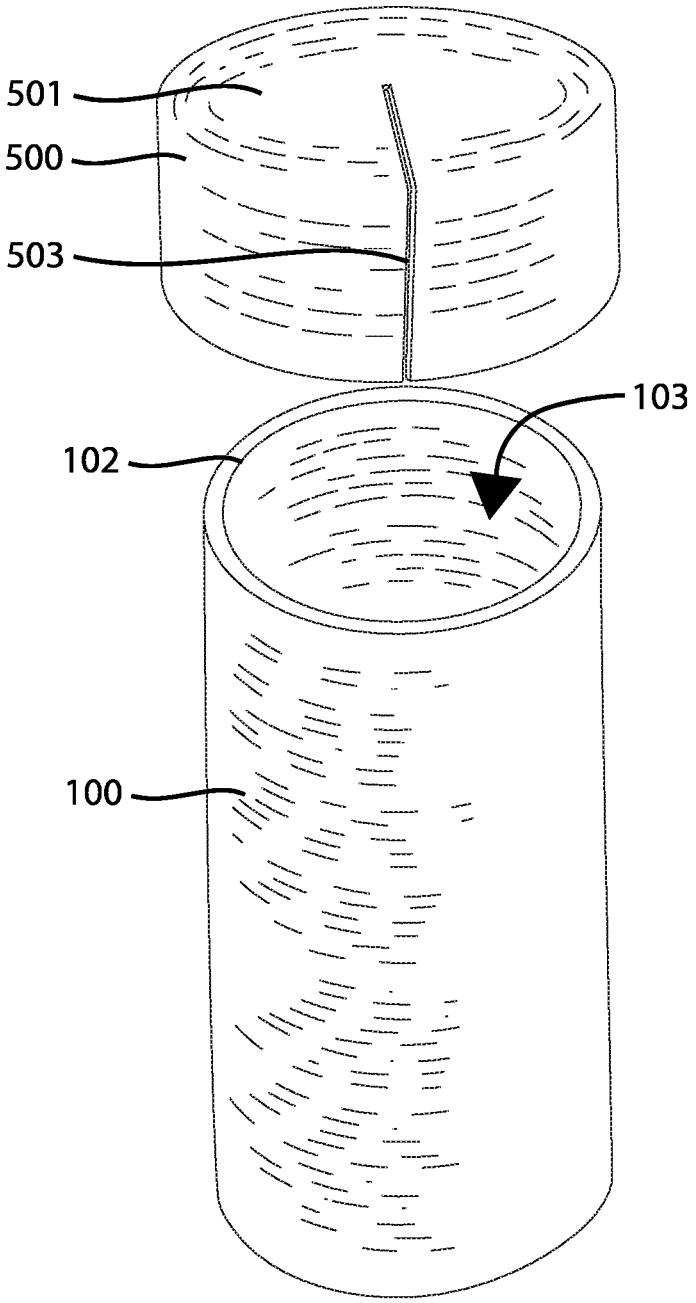
FIG. 6 shows a top perspective view of a receiving tube in accordance with a second illustrated embodiment.
Figure 7:
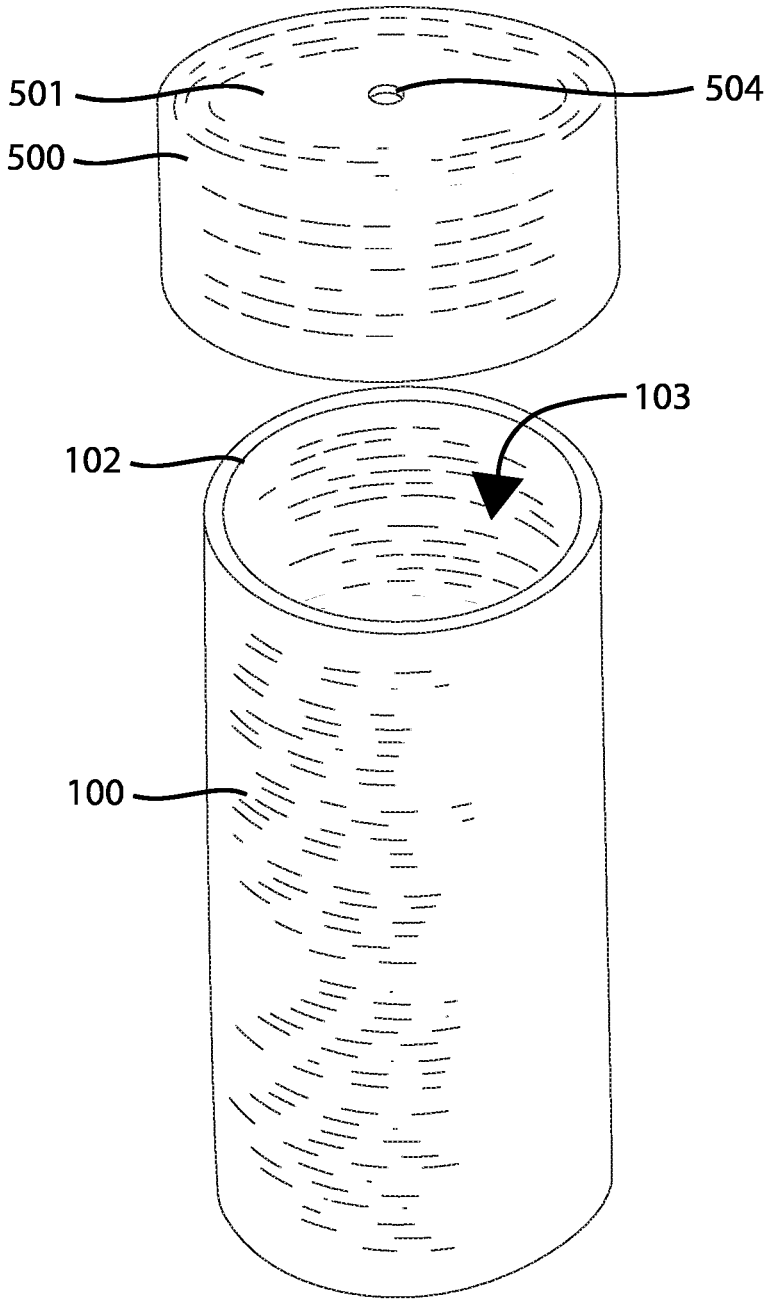
FIG. 7 shows a top perspective view of a receiving tube in accordance with a third illustrated embodiment.

In FIG. 6 an exploded view of the receiving tube (100) and shield (500) are shown. A cable slot (503) is shown on the shield so that when the shield is placed above the storage container the cable (400) may be threaded through the shield slot, locating the handle above the shield when the secure storage system is buried. In other embodiments, the shield may have a cable aperture (504) through which the cable may be threaded, as shown in FIG. 7. The shield upper side (501) is shown in FIG. 6.

Figure 8:
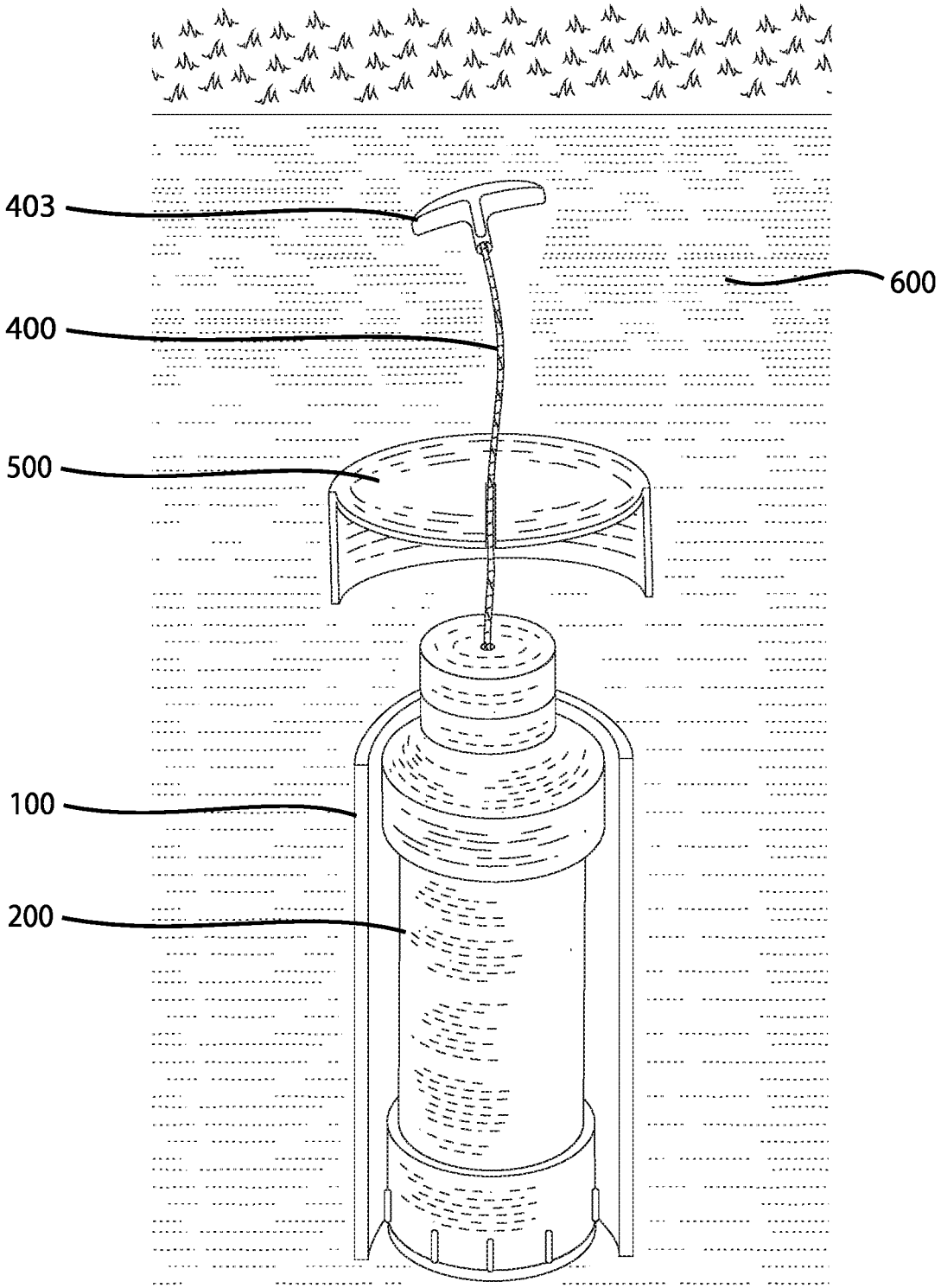
FIG. 8 shows a cut-away view of the underground secure storage system installed in the ground in accordance with a second illustrated embodiment.

Shown in FIG. 8 is the underground secure storage system installed under the ground (600). FIG. 8 shows a cut-away view of the receiving tube (100) with the storage container (200) inside. The cable is threaded through the cable slot (503) in the shield (500). The shield lower side (502) is also visible in FIG. 8.

FEATURE LIST

| | |
|---|---|
| Receiving Tube | (100) |
| Tube Panel | (101) |
| Tube Opening | (102) |
| Tube Compartment | (103) |
| Storage Container | (200) |
| Outside Surface | (201) |
| Inside Surface | (202) |
| Storage Compartment | (203) |
| Container Panel | (204) |
| Container Opening | (205) |
| Container Threads | (206) |
| Cable Attachment Point | (207) |
| Cable Penetration | (208) |
| Top Cover Lid | (209) |
| Lid Connector | (210) |
| Wall | (211) |
| Top Cover | (212) |
| Central Segment | (213) |
| Bottom Cover | (214) |
| Plug | (300) |
| Plug Threads | (301) |
| Plug Spiner | (302) |
| O-Ring | (303) |
| Cable | (400) |
| Proximal End | (401) |
| Distal End | (402) |
| Handle | (403) |
| Handle Penetration | (404) |
| Fastener | (405) |
| Shield | (500) |
| Shield Upper Side | (501) |

-continued

| | |
|---|---|
| Shield Lower Side | (502) |
| Cable Slot | (503) |
| Cable Aperture | (504) |
| Ground | (600) |

What is claimed is:

1. A secure storage system, comprising:

a. A receiving tube; the receiving tube comprising a tube compartment formed from a plurality of tube panels, the receiving tube having at least one tube opening, b. A storage container; the storage container comprising an enclosure, called the storage compartment, formed from a plurality of container panels having at least one container opening, the storage container having container threads disposed on the interior side of the container opening; the storage container having at least one cable attachment point, c. A plug; the plug being a covering which, when installed on the container opening, causes the interior of the storage container to be substantially sealed from the outside environment, the plug having plug threads disposed on the exterior side of the plug, and the plug threads are adapted to be threaded into the container threads, d. A cable, the cable being a flexible, elongated member substantially capable of enduing tensile forces, the cable having a proximal end and a distal end, the proximal end of the cable being attached to the cable attachment point.

2. A secure storage system as in claim 1, wherein:

a. The receiving tube forms a generally cylindrical shape having a rounded central segment following a substantially consistent curvature.

3. A secure storage system as in claim 1, wherein:

a. The storage container forms a generally cylindrical shape having a rounded central segment following a substantially consistent curvature.

4. A secure storage system as in claim 1, wherein:

a. The storage container comprising at least two panels: a top cover and a central segment; the top cover being disposed over the upper end of the central segment, the lower part of the central segment forming the container opening.

5. A secure storage system as in claim 1, wherein:

a. The storage container comprising at least three panels: a top cover, a central segment, and a bottom cover; the top cover being disposed over the upper end of the central segment, the bottom cover being disposed over the lower end of the central segment.

6. A secure storage system as in claim 1, wherein:

a. The storage container comprising at least four panels: a top cover lid, a top cover, a central segment, and a bottom cover; the top cover lid being disposed over the upper end of the top cover, the top cover being disposed over the upper end of the central segment, the bottom cover being disposed over the lower end of the central segment.

7. A secure storage system as in claim 1, wherein:

a. The storage container comprising at least four panels: a lid connector having a wall, a top cover, a central segment, and a bottom cover; the lid connector being disposed within the upper end of the top cover, the top cover being disposed over the upper end of the central segment, the bottom cover being disposed over the lower end of the central segment.

8. A secure storage system as in claim 1, wherein:

a. The container opening is disposed on a lower end of the storage container.

9. A secure storage system comprising:

a. A receiving tube; the receiving tube comprising a tube compartment formed from a plurality of tube panels, the receiving tube having at least one tube opening, b. A storage container; the storage container comprising an enclosure, called the storage compartment, formed from a plurality of container panels having at least one container opening, the storage container having container threads disposed on the exterior side of the container opening: the storage container having at least one cable attachment point, c. A plug; the plug being a covering which, when installed on the container opening, causes the interior of the storage container to be substantially sealed from the outside environment, the plug having plug threads disposed on the interior side of the plug, and the container threads are adapted to be threaded into the plug threads, d. A cable, the cable being a flexible, elongated member substantially capable of enduing tensile forces, the cable having a proximal end and a distal end, the proximal end of the cable being attached to the cable attachment point.

10. A secure storage system as in claim 1, further comprising:

a. A handle; the handle being attached to the distal end of the cable.

11. The secure storage system in claim 1, wherein:

a. One or more of the container panels is generally made of ABS material.

12. The secure storage system in claim 1, wherein:

a. The cable is generally made of stainless steel material.

13. A secure storage system as in claim 1, further comprising:

a. A shield; the shield having a width dimension which exceeds the width dimension of the receiving tube.

14. A secure storage system as in claim 13, wherein:

a. The shield is configured with at least one cable slot; the cable slot comprising a cut through the shield from the horizontal perimeter of the shield into the interior of the shield, the cable slot being sized such that the cable may pass through the cable slot.

15. A secure storage system as in claim 13, wherein:

a. The shield is configured with at least one cable aperture; the cable aperture comprising a penetration through the shield between the shield top surface to the shield bottom surface, the cable aperture being sized such that the cable may pass through the cable aperture.

16. A secure storage system as in claim 13, wherein:

a. The shield upper side has a generally convex shape.

17. A secure storage system as in claim 13, wherein:

a. The shield lower side has a generally concave shape.

18. A secure storage system, comprising:

a. A receiving tube; the receiving tube comprising generally cylindrical tube compartment formed from a plurality of tube panels, the receiving tube having at least one tube opening, the receiving tube made of ABS material, b. A storage container; the storage container comprising a generally cylindrical enclosure, called the storage compartment, formed from a plurality of container panels having at least one container opening; the container opening being disposed on the lower end of the storage container, the storage container having at least one cable attachment point, the storage container being generally made of ABS material, c. A plug; the plug being a covering which, when installed on the container opening, causes the interior of the storage container to be substantially sealed from the outside environment, d. A cable, the cable being a flexible, elongated member substantially capable of enduing tensile forces, the cable having a proximal end and a distal end, the proximal end of the cable being attached to the cable attachment point, the cable being generally made of stainless steel material, e. A shield; the shield having a width dimension which exceeds the width dimension of the receiving tube, the shield being configured with at least one cable slot, the cable slot comprising a cut through the shield from the horizontal perimeter of the shield into the interior of the shield, the cable slot being sized such that the cable may pass through the cable slot.

* * * * *